US005598502A

United States Patent [19]

Takahashi et al.

[11] Patent Number: 5,598,502

[45] Date of Patent: Jan. 28, 1997

[54] PTC HEATER FOR USE IN LIQUID WITH CLOSE ELECTRICAL AND THERMAL COUPLING BETWEEN ELECTRODE PLATES AND THERMISTORS

[75] Inventors: Minoru Takahashi; Makoto Ono, both of Tokyo, Japan

[73] Assignee: TDK Corporation, Tokyo, Japan

[21] Appl. No.: 285,449

[22] Filed: Aug. 5, 1994

[30] Foreign Application Priority Data

Aug. 20, 1993 [JP] Japan ..... 5-049970 U
Apr. 19, 1994 [JP] Japan ..... 6-080232

[51] Int. Cl.[6] ..... H05B 3/14

[52] U.S. Cl. ..... 392/502; 219/505; 219/541; 219/544; 219/523; 219/537

[58] Field of Search ..... 392/502, 500; 219/505, 541, 544, 530, 523, 537; 338/22 R, 254, 256, 257, 271, 272, 306, 328

[56] References Cited

U.S. PATENT DOCUMENTS

| | | | |
|---|---|---|---|
| 3,996,447 | 12/1976 | Bouffard et al. | 219/541 |
| 4,242,567 | 12/1980 | Carter | 219/505 |
| 4,401,885 | 8/1983 | Ishii et al. | 219/523 |
| 4,426,573 | 1/1984 | Fudickar et al. | 219/505 |
| 4,482,801 | 11/1984 | Habata et al. | 219/505 |
| 4,689,878 | 9/1987 | Beauregard et al. | 219/505 |
| 4,814,584 | 3/1989 | Bohlender et al. | 219/535 |
| 4,822,980 | 4/1989 | Carbone et al. | 392/502 |
| 5,125,070 | 6/1992 | Chung-Tai | 219/505 |
| 5,354,969 | 10/1994 | Akiyama et al. | 219/541 |

FOREIGN PATENT DOCUMENTS

| | | | |
|---|---|---|---|
| 2804860 | 8/1979 | Germany | 219/505 |
| 61-6638 | 2/1986 | Japan . | |
| 64-54688 | 3/1989 | Japan | 219/505 |
| 3-187182 | 8/1991 | Japan | 392/502 |
| 4-36071 | 8/1992 | Japan . | |

*Primary Examiner*—John A. Jeffery
*Attorney, Agent, or Firm*— Oblon, Spivak, McClelland, Maier & Neustadt, P.C.

[57] ABSTRACT

A heater for heating a liquid in which the electrical contact between a PTC thermistor and electrode plates is surely realized, and the thermal coupling and the thermal efficiency are excellent. In a case 1, an internal space 13 has an opening 14 at one side portion, and the whole of the periphery of the case is closed except the opening 14. A pair of electrode plates 21 and 22 have projections 211 and 221 on faces 212 and 222, and are housed in the internal space 13 of the case 1 in such a manner that their other faces 223 are opposed to heat radiating faces 11 and 12. The PTC thermistors are disposed between the electrode plates 21 and 22 in such a manner that projections 211 and 221 are contacted with the electrodes 32 and 33, respectively. Thermal conductive fillers 41 and 42 made of a resin are charged between the electrodes 32 and 33 of the PTC thermistors 3 and the electrode plates 21 and 22 so as to fill the gaps which are formed by the projections 211 and 221.

7 Claims, 12 Drawing Sheets

PTC HEATER FOR USE IN LIQUID WITH CLOSE ELECTRICAL AND THERMAL COUPLING BETWEEN ELECTRODE PLATES AND THERMISTORS

BACKGROUND OF THE INVENTION

The invention relates to a heater suitable for heating a liquid such as water, or oil.

A heater in which a positive temperature coefficient thermistor (hereinafter, often referred to as "PTC thermistor") is used as a heater element has been well known in the art. Since a PTC thermistor operates at a constant temperature because of its self temperature control function, a heater which is safer and has a high reliability can be realized by using such a PTC thermistor. A heater of this kind has a structure in which a PTC thermistor is sandwiched between a pair of electrode plates and driven through the electrode plates. The electrode plates are thermally coupled indirectly or directly with radiating plates through which heat is taken out. When such a heater is used for heating a liquid such as water or oil, the radiating plates are configured as a part of a case in which basic elements such as the PTC thermistor, and the electrode plates are housed. When a large amount of heat is to be generated, a plurality of PTC thermistors are used, the PTC thermistors are sandwiched between a pair of common electrode plates, and the plural PTC thermistors are simultaneously driven through the electrode plates. Such an assembly structure is disclosed in, for example, Postexamined Japanese Utility Model Publication (Kokuku) Hei-4-36071.

As described above, in such a heater, the electrode plates are used as elements for supplying a power to the PTC thermistor and also as heat conductors. Therefore, it is very important to establish a close electrical connection and thermal coupling between the electrode plates and the PTC thermistors. However, these conditions must surely be satisfied while facilitating assembly and maintaining a simplified structure. This involves technical difficulties. As disclosed in Japanese Utility Model Publication (Kokuku) Hei-4-36071, for example, an electrical connection and thermal coupling between electrode plates and PTC thermistors are improved by using a clamping force exerted by a case. This structure has drawbacks that the structure of the case and the works of assembling the case are complicated. Furthermore, an excessive clamping force may cause the PTC thermistors, which are made of ceramics, to be damaged or crack.

As means for ensuring an electrical connection, a structure has been proposed in which projections are formed on electrode plates and the projections are contacted with electrodes of a PTC thermistor. In this structure, however, gaps the size of which is equal to the height of the projections are formed between the electrode plates and the PTC thermistor, so that the degree of thermal coupling is reduced, thereby lowering the thermal efficiency.

The above-mentioned problems become more noticeable in a structure where a plurality of PTC thermistors are commonly sandwiched between a pair of electrode plates and simultaneously driven.

When a heater for heating a liquid such as water, or oil is to be produced, another technical difficulty arises as follows: In addition to structure a case which functions also as a radiating portion in the liquid, so as to be hermetically sealed to surely block the ingress of the liquid, the electrical contact and thermal coupling between the electrode plates and the PTC thermistor must be improved.

SUMMARY OF THE INVENTION

It is an object of the invention to provide a heater for heating a liquid which generates heat at a constant temperature on the basis of the self temperature control function.

It is another object of the invention to provide a heater for heating a liquid which can easily be assembled.

It is a further object of the invention to provide a heater for heating a liquid in which the electrical contact between a PTC thermistor and electrode plates is surely realized, and the thermal coupling and the thermal efficiency are excellent.

It is a still further object of the invention to provide a heater in which the thermal coupling and electrical contact between a PTC thermistor and electrode plates are stably realized when the heater operates to generate heat.

It is a still further object of the invention to provide a heater in which a PTC thermistor can surely be positioned at a predetermined location.

It is a still further object of the invention to provide a heater in which deterioration of a PTC thermistor, and a thermal runaway associated therewith are surely prevented from occurring.

In order to solve the above-discussed problems, the heater according to the invention comprises a case, at least two electrode plates, one or more positive temperature coefficient thermistors, and a thermal conductive resin used as a filler. The case has a pair of radiating surfaces which are opposed to each other through a spacing, thereby forming an internal space. The internal space has an opening at one end which constitutes a side portion with respect to the radiating surfaces, and the whole of the periphery of the case is closed except the opening. Each of the electrode plates has projections on one surface, and is housed in the internal space of the case while the other surface of the electrode plate is directed to one of the radiating surfaces. Each of the positive temperature coefficient thermistors has electrodes on both faces which are in a thickness direction of an element of the positive temperature coefficient thermistor, and is disposed between the electrode plates while the projections are contacted with the electrodes. The thermal conductive filler is made of a resin, and charged between the electrodes of the positive temperature coefficient thermistors and the electrode plates, to fill gaps which are formed by the projections.

Preferably, the thermal conductive filler made of a resin may be charged also between the back faces of the electrodes and the inner face of the case.

Preferably, the heater further comprises at least one insulating frame member which is disposed between the electrode plates, and which has one or more holes. The number of the holes corresponding to the number of the positive temperature coefficient thermistors. The positive temperature coefficient thermistors are disposed in the holes of the insulating frame member, respectively.

More preferably, the insulating frame member has one or more air paths through which the holes are communicated with adjacent ones and led to the outside of the case.

Each PTC thermistor has electrodes on both faces which are in a thickness direction of an element of the positive temperature coefficient thermistor, and is disposed between the electrode plates in the internal space of the case. Therefore, a heater is obtained in which the PTC thermistor is powered through the electrode plates to generate heat at a constant temperature in accordance with the self temperature control function of the PTC thermistor.

The case has a pair of radiating surfaces which are opposed to each other through a spacing, the two radiating surfaces form an internal space, and the internal space has an opening at one end which constitutes a side portion with respect to the radiating surfaces. Therefore, the components such as the PTC thermistor, and the electrode plates can be inserted into the internal space of the case through the opening, thereby facilitating the assembly of the heater.

The whole of the periphery of the case is closed except the opening. Even when the side portion of the case which is opposite to the side portion in the side of the opening is immersed into a liquid such as water, or oil, therefore, the liquid is prevented from entering the internal space of the case in which the PTC thermistor, and the electrode plates are disposed. Accordingly, the resulting heater for heating a liquid has a high reliability.

The electrode plates respectively have the projections on one face, and the PTC thermistor is disposed between the electrode plates in such a manner that the projections are contacted with the electrodes, respectively. Therefore, the electrode plates are surely contacted with the electrodes of the PTC thermistor through the projections.

Since the electrode plates are contacted with the electrodes of the PTC thermistor through the projections, gaps the size of which corresponds to the height of the projections are formed between the electrode plates and the electrodes of the PTC thermistor. The presence of the gaps may decrease the efficiency of the thermal conduction from the PTC thermistor to the electrode plates. According to the invention, however, the thermal conductive fillers are charged between the electrodes of the PTC thermistor and the electrode plates so as to fill the gaps which are formed by the projections, and hence heat generated by the PTC thermistor is surely conducted through the thermal conductive filler to the electrode plates. Although the electrode plates are separated from the electrodes of the PTC thermistor by the projections, therefore, a superior thermal coupling between the electrode plates and the electrodes is established. Consequently, a heater is obtained in which the electrical contact between the electrode plates and the PTC thermistor is ensured and the efficiency of the thermal conduction from the PTC thermistor to the electrode plates is improved.

Since the thermal conductive filler is made of a resin, the coefficient of thermal expansion of the filler is greater than that of the electrode plates which are generally structured by a metal plate. When the PTC thermistor operates to generate heat, therefore, thermal strains due to the difference between the coefficient of thermal expansion of the thermal conductive filler and that of the electrode plates are generated in the thermal conductive filler. The thermal strains are applied to the electrode plates. The electrode plates are housed in the internal space of the case in such a manner that the other faces which are opposite to the faces having the projections are opposed to the radiating surfaces. When the electrode plates are subjected to the thermal strains due to the thermal expansion of the thermal conductive filler, therefore, the other faces of the electrode plates are pressed toward the radiating surfaces. This causes the electrode plates to achieve a close thermal coupling between the electrode plates and the radiating surfaces.

On the other hand, the electrode plates have the projections on one face. Therefore, the projections are pressed against the surfaces of the electrodes of the PTC thermistor by a reaction occurring when the electrode plates are subjected to the thermal strains. Even when the thermistor operates to generate heat, therefore, an electrical contact is stably obtained.

Also in the case where a plurality of PTC thermistors are used in order to increase the heat value, the above-described structure may be formed between the electrode plates and each of the PTC thermistors, whereby each of the PTC thermistors is allowed to attain aforementioned effects.

In a preferred example wherein at least one insulating frame member is disposed and has one or more holes the number of which corresponds to the number of positive temperature coefficient thermistors, and the positive temperature coefficient thermistors are respectively disposed in the holes of the insulating frame member, each of the PTC thermistors is positioned by the respective hole of the insulating frame member, whereby the insulating frame members are prevented from being positionally displaced. Therefore, an electrical short-circuit between the PTC thermistors due to a positional displacement or movement of the PTC thermistors is prevented from occurring, thereby realizing a heater having a high reliability.

In a preferred example wherein an insulating frame member has air paths through which holes are communicated with adjacent ones and led to the outside of the case, air is sufficiently supplied through the air paths into the holes in which the PTC thermistors are disposed. Therefore, deterioration of the PTC thermistors, and a thermal runaway and thermal destruction associated therewith are surely prevented from occurring.

DETAILED DESCRIPTION OF PREFERRED EMBODIMENTS

Figure 1:
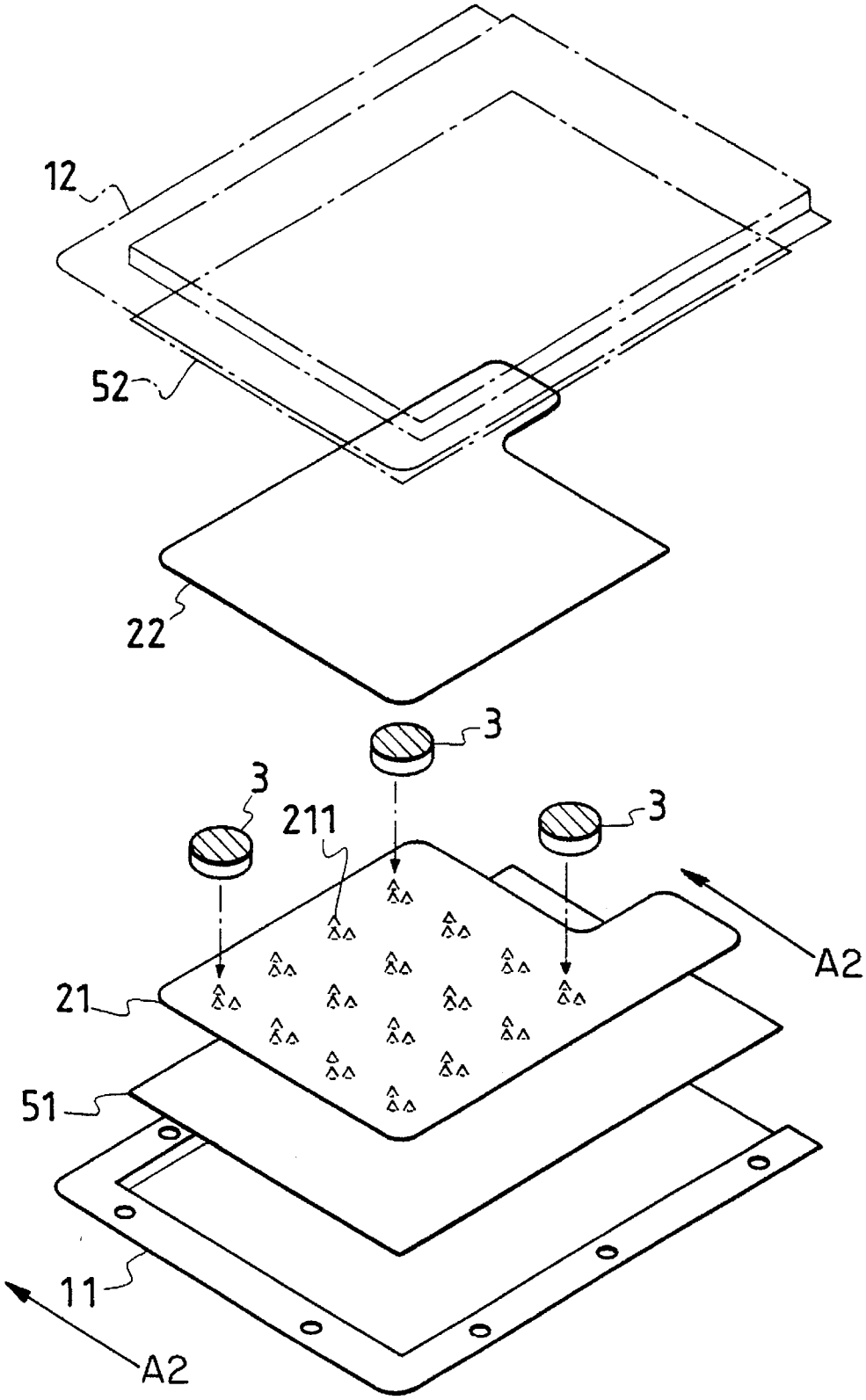
FIG. 1 is an exploded perspective view of a heater according to the invention.
Figure 2:
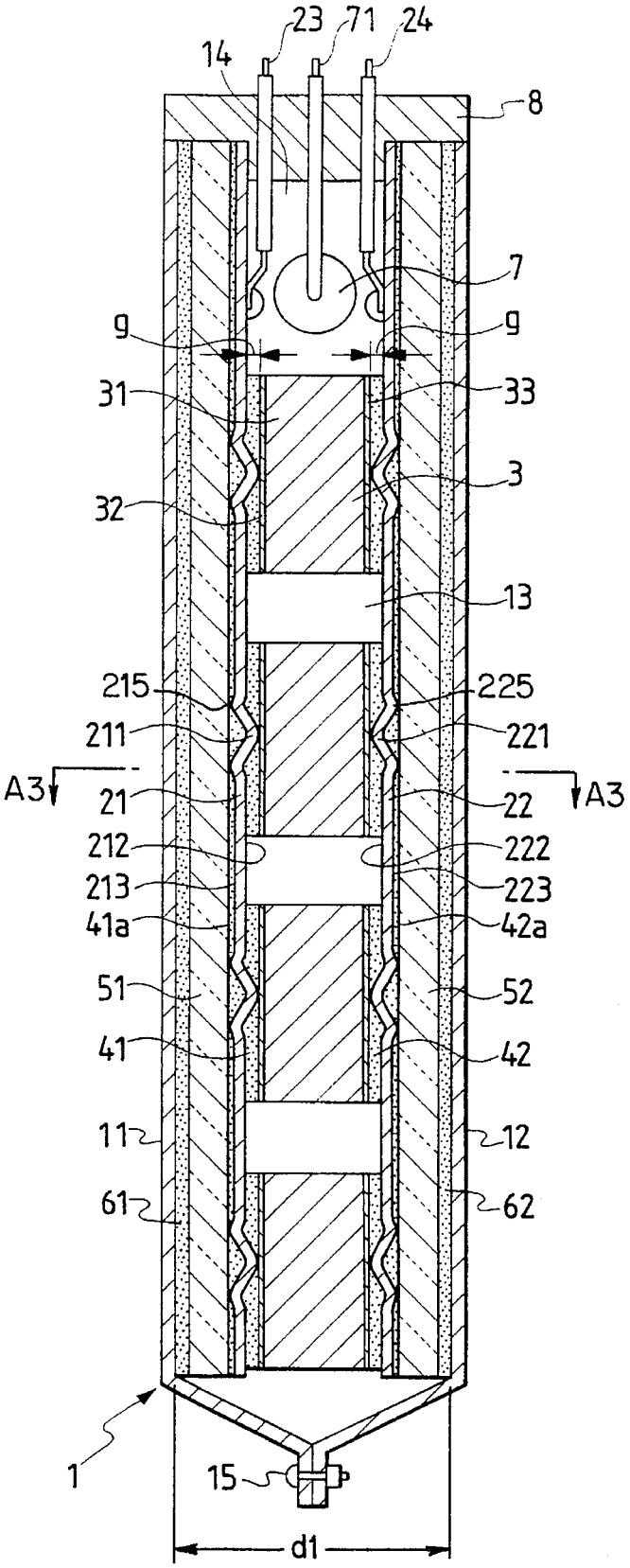
FIG. 2 is a section view of the heater according to the invention taken along the line A2—A2 as shown in FIG. 1.
Figure 3:
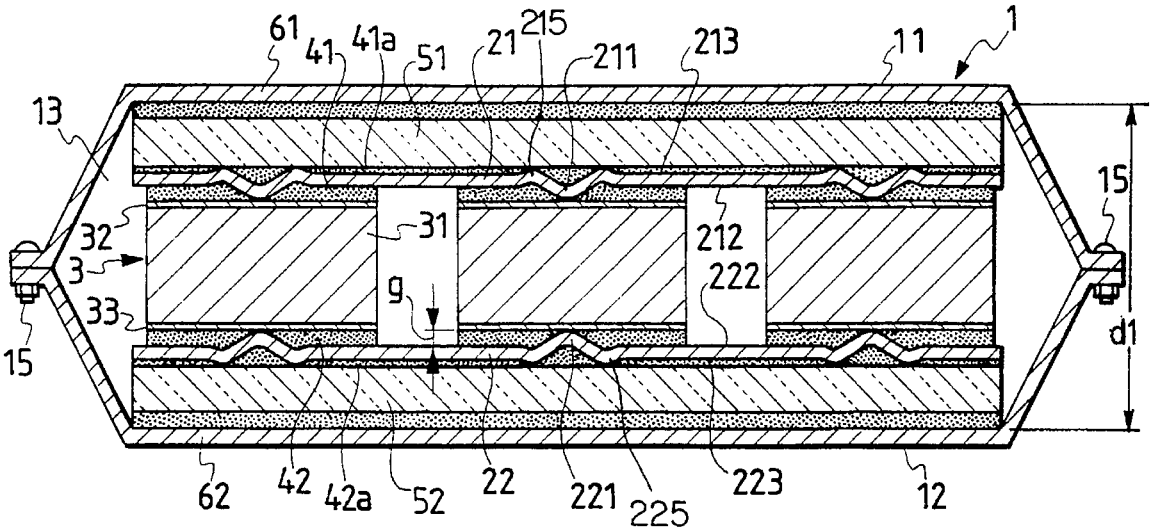
FIG. 3 is a section view taken along line A3—A3 of FIG. 2.

FIG. 1 is an exploded perspective view of a heater according to the invention, FIG. 2 is a section view of the heater according to the invention, taken along the line A2—A2 as shown in FIG. 1, and FIG. 3 is a section view taken along line A3—A3 of FIG. 2. The heater of the invention comprises a case 1, electrode plates 21 and 22, PTC thermistors 3, and thermal conductive fillers 41 and 42.

Figure 13:
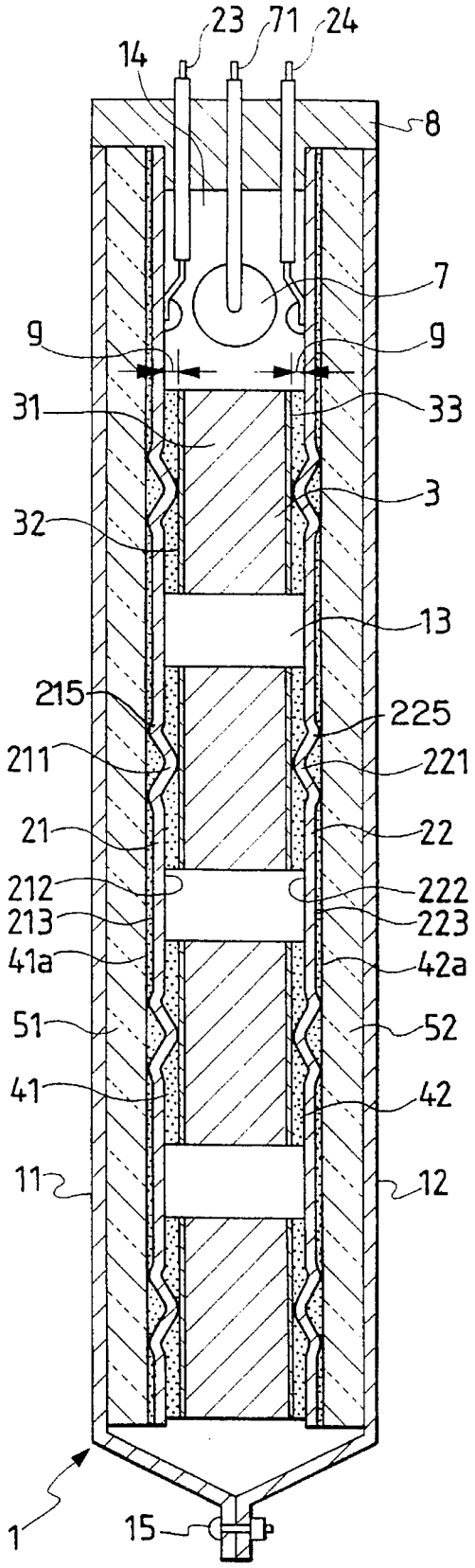
FIG. 13 is a section view showing an assembled state of the heater when electrical insulating layers have a function as adhesive layers in the structure shown in FIGS. 1 to 3.
Figure 14:
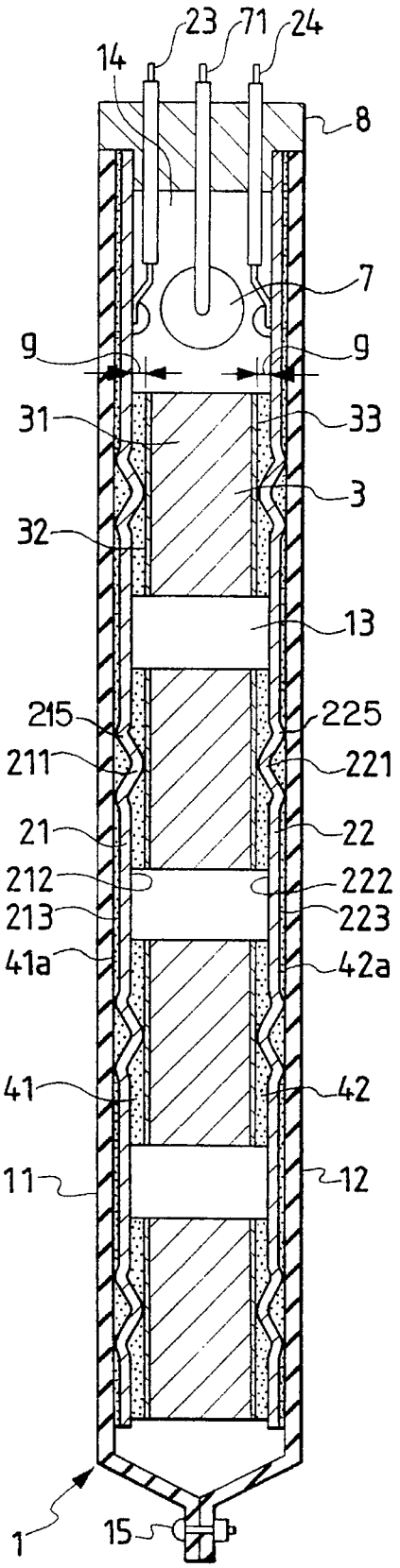
FIG. 14 is a section view showing an assembled state of the heater when a case is made of insulator so that electrical insulating layers are omitted in the structure shown in FIGS. 1 to 3.

The case 1 has an internal space 13 formed by a pair of radiating surfaces 11 and 12 which are opposed to each other through a spacing d1. The internal space 13 has an opening 14 at one side portion which constitutes a side portion with respect to the radiating surfaces 11 and 12, and the whole of the periphery of the case is closed except the opening 14. The case 1 of the embodiment is made of a metal plate such as a stainless steel plate, and the periphery of the case is hermetically sealed by a mechanical coupling using coupling members 15 such as bolts and nuts, or by other means such as welding, or adhesion. Electrical insulating layers 51 and 52 are formed between the radiating surfaces 11 and 12 of the case 1 and the electrode plates 21 and 22. The electrical insulating layers 51 and 52 may be made of an electrical insulating material which has high heat resistance and is excellent in heat conduction, such as alumina, aluminum nitride, polyimide, or mica. Preferably, the faces of the electrical insulating layers 51 and 52 and the case 1 which are contacted with each other are adhered to each other by heat resistant adhesives 61 and 62 having a high thermal conductivity. As the heat resistant adhesives 61 and 62, a thermoplastic polyimide resin, or silicon resin may be used. When the electrical insulating layers 51 and 52 are made of thermoplastic polyimide, they may function also as adhesive layers. The case 1 may be made of alumina or the like. According to this configuration, the electrical insulating layers 51 and 52 may be omitted (see FIGS. 13 and 14).

The electrode plates 21 and 22 form a pair, and each of the electrode plates 21 and 22 has projections 211, 221 on one face and projections 215, 225 on another face electrode plates 21 and 22 are housed in the internal space 13 of the case 1 in such a manner that their faces 212 and 222 are opposed to each other through a predetermined spacing and their other faces 213 and 223 are supported by the radiating surfaces 11 and 12. In the embodiment, three or four projections 211 and 221 are grouped to constitute one set, and sets of the projections are arranged at appropriate intervals. The reference numerals 23 and 24 designate lead wires connected to the electrode plates 21 and 22.

Each PTC thermistor 3 has electrodes 32 and 33 on the two faces of the element 31 of the PTC thermistor in the thickness direction, and is disposed between the electrode plates 21 and 22 in the internal space 13 of the case 1 in such a manner that the projections 211 and 221 are pressingly contacted with the electrodes 32 and 33, respectively. In the illustrated embodiment, a plurality of the PTC thermistors 3 are disposed in such a manner that the projections 211 and 221 are pressingly contacted with the electrodes 32 and 33, respectively.

The thermal conductive fillers 41 and 42 are made of a resin, and charged between the electrodes 32 and 33 of the PTC thermistors 3 and the electrode plates 21 and 22 so as to fill gaps g which are formed by the projections 211 and 221. As the thermal conductive fillers, used is a resin which is excellent in heat resistance, adhesiveness, and fire resistance as well as heat conductivity. Specific examples of the thermal conductive fillers 41 and 42 include a polyimide resin or a silicon resin.

Furthermore, thermal conductive fillers 41*a* and 42*a* are charged between the back faces of the electrode plates 21 and 22 and the electrical insulating layers 51 and 52.

As described above, the PTC thermistors 3 have the electrodes 32 and 33 on the two faces of the PTC thermistor elements 31 in the thickness direction and are disposed in the spacings between the electrode plates 21 and 22 in the internal space 13 of the case 1. Therefore, a heater is obtained in which the PTC thermistors 3 are powered through the electrode plates 21 and 22 to generate heat at a constant temperature in accordance with the self temperature control function of the PTC thermistors 3.

The case 1 has the internal space 13 formed by a pair of the radiating surfaces 11 and 12 which are opposed to each other through the predetermined spacing. The internal space 13 has the opening 14 at one side portion which constitutes a side portion with respect to the radiating surfaces 11 and 12. Therefore, the components such as the PTC thermistors 3, and the electrode plates 21 and 22 can be inserted into the internal space 13 of the case 1 through the opening 14, thereby facilitating the assembly of the heater.

The whole of the periphery of the case 1 is closed except the opening 14. Even when the side portion of the case which is opposite to the side portion in the side of the opening 14 is immersed into a liquid such as water, or oil, therefore, the liquid is prevented from entering the internal space 13 of the case 1 in which the PTC thermistors 3, and the electrode plates 21 and 22 are disposed. Accordingly, the resulting heater for heating a liquid has a high reliability.

The electrode plates 21 and 22 have the projections 211 and 221 on one face, and the PTC thermistors 3 are disposed in the spacing between the electrode plates 21 and 22 in such a manner that the projections 211 and 221 are pressingly contacted with the electrodes 32 and 33, respectively. Therefore, the electrode plates 21 and 22 are surely contacted with the electrodes 32 and 33 of the PTC thermistors 3 through the projections 211 and 221.

Since the electrode plates 21 and 22 are pressingly contacted with the electrodes 32 and 33 of the PTC thermistors 3 through the projections 211 and 221, the gaps g the size of which corresponds to the height of the projections 211 and 221 are formed between the electrode plates 21 and 22 and the electrodes 32 and 33 of the PTC thermistors 3. The presence of the gaps g may decrease the efficiency of the thermal conduction from the PTC thermistors 3 to the electrode plates 21 and 22. According to the invention, however, the thermal conductive fillers 41 and 42 are charged between the electrodes 32 and 33 of the PTC thermistors 3 and the electrode plates 21 and 22 so as to fill the gaps g which are formed by the projections 211 and 221, and hence heat generated by the PTC thermistors 3 is surely conducted through the thermal conductive fillers 41 and 42 to the electrode plates 21 and 22. Although the electrode plates 21 and 22 are separated from the electrodes 32 and 33 of the PTC thermistors 3 by the projections 211 and 221, therefore, a superior thermal coupling between the electrode plates and the electrodes is established. Consequently, a heater is obtained in which the electrical contact between the electrode plates 21 and 22 and the PTC thermistors 3 is ensured and the efficiency of the thermal conduction from the PTC thermistors 3 to the electrode plates 21 and 22 is improved.

In addition, since the thermal conductive fillers 41*a* and 42*a* are charged between the back faces of the electrode plates 21 and 22 and the electrical insulating layers 51 and 52, the heat conducted to the electrode plates 21 and 22 is surely conducted to the radiating surfaces 11 and 12 of the case 1. Consequently, the heat generated by the PTC thermistors 3 can efficiently be conducted to the radiating surfaces 11 and 12.

Figure 4:
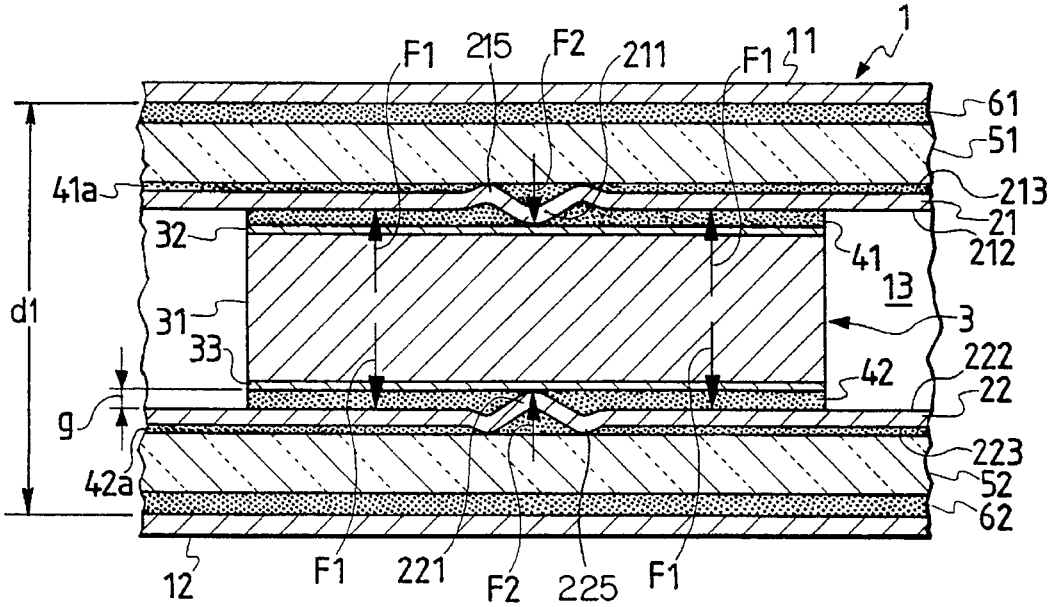
FIG. 4 is an enlarged partial section view of the heater of FIGS. 1 to 3.

Since the thermal conductive fillers 41 and 42 are made of a resin, the coefficient of thermal expansion of the fillers is greater than that of the electrode plates 21 and 22 which are generally structured by a metal plate. When the PTC thermistors 3 operate to generate heat, therefore, thermal strains F1 due to the difference between the coefficient of thermal expansion of the thermal conductive fillers 41 and 42 and that of the electrode plates 21 and 22 are generated in the thermal conductive fillers 41 and 42 as shown in FIG. 4. The thermal strains F1 are applied to the electrode plates 21 and 22. The electrode plates 21 and 22 are housed in the internal space 13 of the case 1 in such a manner that the other faces which are opposite to the faces having the projections 211 and 221 are supported by the radiating surfaces 11 and 12. When the electrode plates 21 and 22 are subjected to the thermal strains F1 due to the thermal expansion of the thermal conductive fillers 41 and 42, therefore, the other faces 213 and 223 of the electrode plates 21 and 22 are pressed toward the radiating surfaces 11 and 12. This causes the electrode plates 21 and 22 to achieve a close thermal coupling with the radiating surfaces 11 and 12, thereby improving the efficiency of the thermal conduction. When the thermal conductive fillers 41 and 42 have adhesive properties, the effect of the thermal strains is further enhanced.

On the other hand, each of the electrode plates 21, 22 has projections 215, 225 on the other face. When the electrode plates 21 and 22 are subjected to the thermal strains F1, therefore, the projections 211 and 221 are pressed in a counteractive manner against the surfaces of the electrodes 32 and 33 of the PTC thermistors 3 in the directions of arrows F2. Even when the thermistors operate to generate heat, therefore, an electrical contact is stably obtained.

In the embodiment, the heater comprises a thermal fuse 7 which is housed in the internal space 13 of the case 1. When the PTC thermistors 3 abnormally generate heat because of a malfunction or the like, the thermal fuse 7 operates through circuit wiring (which are not shown) so as to interrupt the power supply to the PTC thermistors 3. The reference numeral 71 designates lead wires of the thermal fuse 7. Since the case 1 has the opening 14 at one side portion at which the internal space 13 constitutes a side portion with respect to the radiating surfaces 11 and 12, the thermal fuse 7 can easily be inserted through the opening 14 into the internal space 13. In FIGS. 1 to 3, the reference numeral 8 designates a lid.

Figure 5:
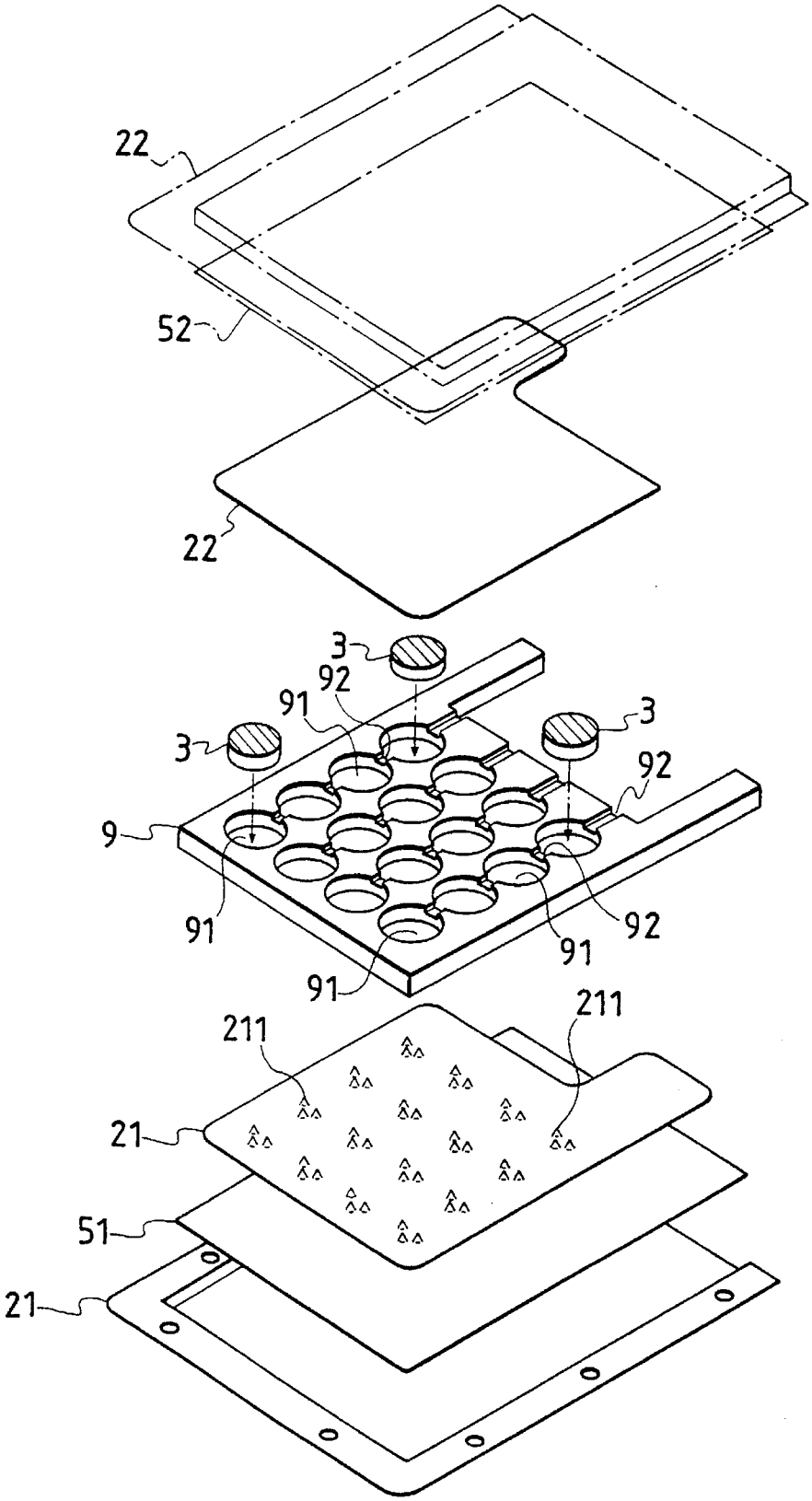
FIG. 5 is an exploded perspective view showing another embodiment of the heater of the invention.
Figure 6:
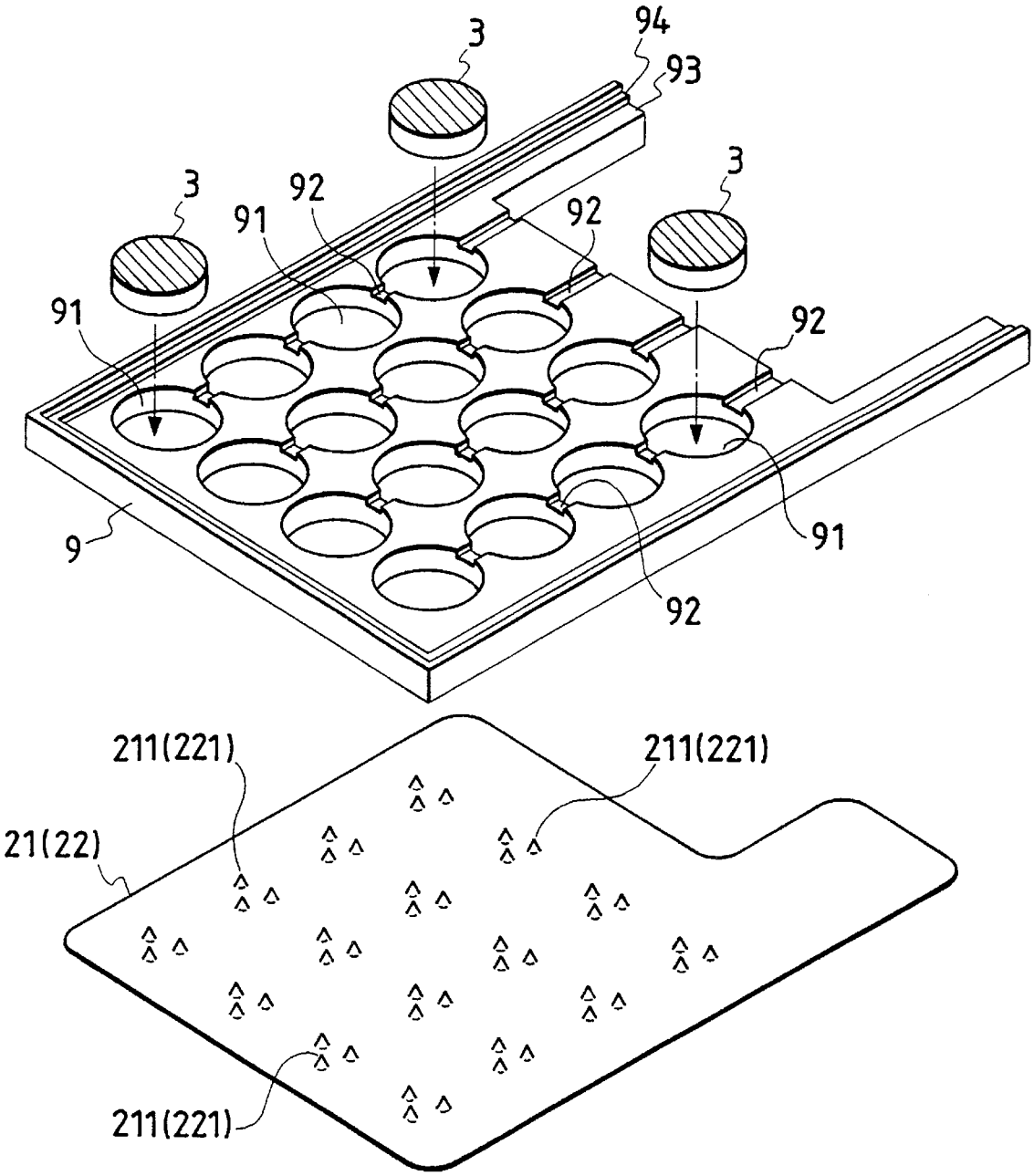
FIG. 6 is an enlarged perspective view showing a combination of an insulating frame member and electrode plates which constitute the heater of FIG. 5.
Figure 7:
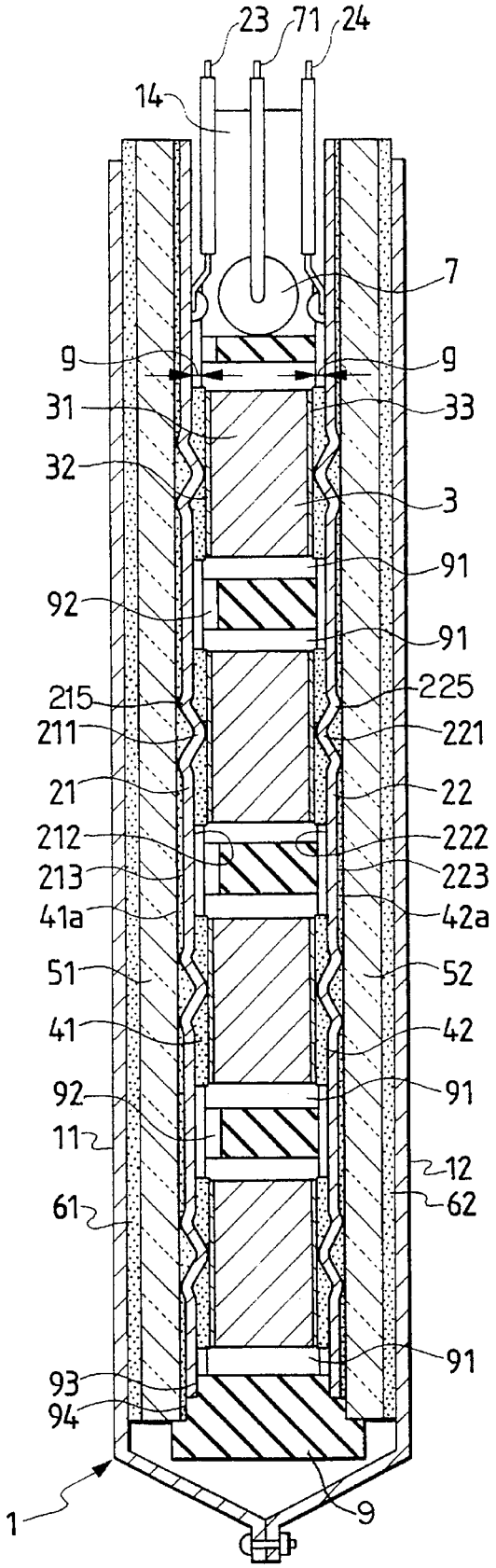
FIG. 7 is a section view showing an assembled state of the heater of FIGS. 5 and 6.

FIG. 5 is an exploded perspective view showing another embodiment of the heater of the invention, FIG. 6 is an enlarged perspective view showing a combination of an insulating frame member and electrode plates which constitute the heater of FIG. 5, and FIG. 7 is a section view showing an assembled state of the heater of FIG. 5. In the figures, the reference numerals same as those of FIGS. 1 to 4 designate the identical components.

The heater of the embodiment comprises at least one insulating frame member 9. The insulating frame member 9 has holes 91 the number of which corresponds to that of the PTC thermistors 3, and is disposed between the electrode plates 21 and 22. The PTC thermistors 3 are disposed in the holes 91 of the insulating frame member 9, respectively. According to this structure, each of the PTC thermistors 3 is positioned by the corresponding hole 91 of the insulating frame member 9. Consequently, unevenness of heat generation due to positional displacements of the PTC thermistors 3 is eliminated, and the resin is prevented from adhering to the side faces of the PTC thermistors 3, thereby realizing a highly reliable heater. The insulating frame member 9 is made of an electrically insulating material which has an excellent heat resistance. The holes 91 may be circular or polygonal.

Furthermore, the insulating frame member 9 has air paths 92 through which the holes 91 are communicated with adjacent ones. As shown in FIG. 7, there is no lid at the opening 14. Among the air paths 92, those connected only to the holes 91 which are located at the end portion are opened outside the case 1. Therefore, all the holes 91 are communicated with the outside of the case through the air paths 92. According to this structure, air is sufficiently supplied through the air paths 92 into the holes 91 in which the PTC thermistors 3 are disposed. Therefore, the ceramics elements 31 constituting the PTC thermistors 3, such as barium titanate semiconductor ceramics are prevented from being deteriorated, whereby deterioration of the PTC thermistors 3, and a thermal runaway and destruction associated therewith are surely prevented from occurring. It was discovered that, in the case where the air paths 92 are not formed, the holes 91 in which the PTC thermistors 3 are disposed are sealed and the peak resistance value of the PTC thermistors 3 is lowered to produce a possibility of allowing a thermal runaway to occur. The reason of this phenomenon is presumed as follows: In a structure where the thermal conductive fillers 41 and 42 made of a resin are charged between the electrodes 32 and 33 of the PTC thermistors 3 and the electrode plates 21 and 22 so as to fill the gaps which are formed by the projections 211 and 221, the holes 91 in which the PTC thermistors 3 are disposed are closed when the insulating frame member 9 is closely contacted with the electrode plates 21 and 22. Therefore, the ceramics elements 31 constituting the PTC thermistors 3 are subjected to a reduction reaction by heated air in the holes 91. According to the preferred embodiment of the invention, this problem can be solved as described above.

In the illustrated embodiment, the holes 91 are arranged in a lattice-like form, and the air paths 92 are formed in such a manner that a group of the holes 91 belonging to the same column are sequentially connected. In place of such an arrangement of the air paths 92, an alternative arrangement may be employed in which a group of the holes 91 belonging to the same row are sequentially connected or the holes 91 belonging to different rows or columns are sequentially connected. Alternatively, the air paths 92 may be formed on the both faces of the insulating frame member 9, or as holes passing through the insulating frame member 9 in place of the illustrated grooves.

Figure 10:
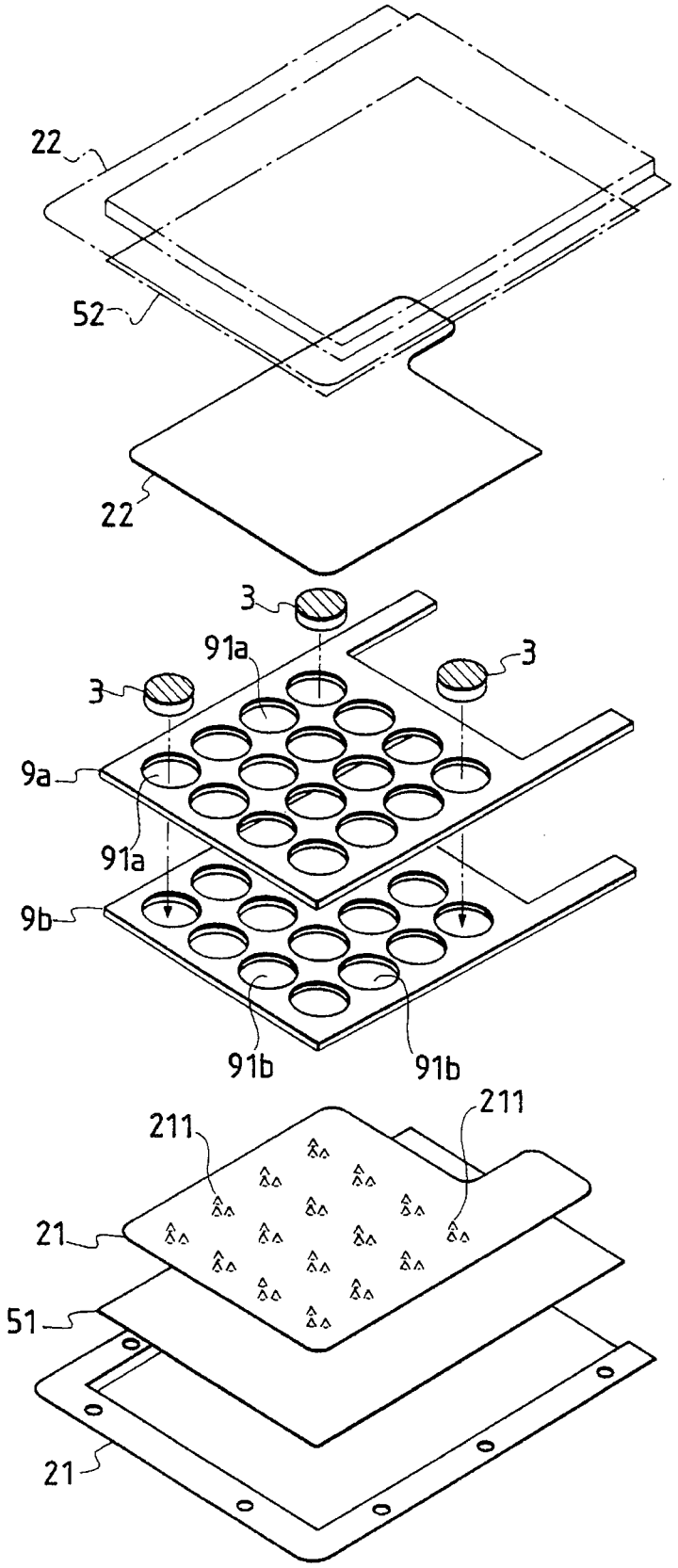
FIG. 10 is an exploded perspective view showing another embodiment of the invention.
Figure 11:
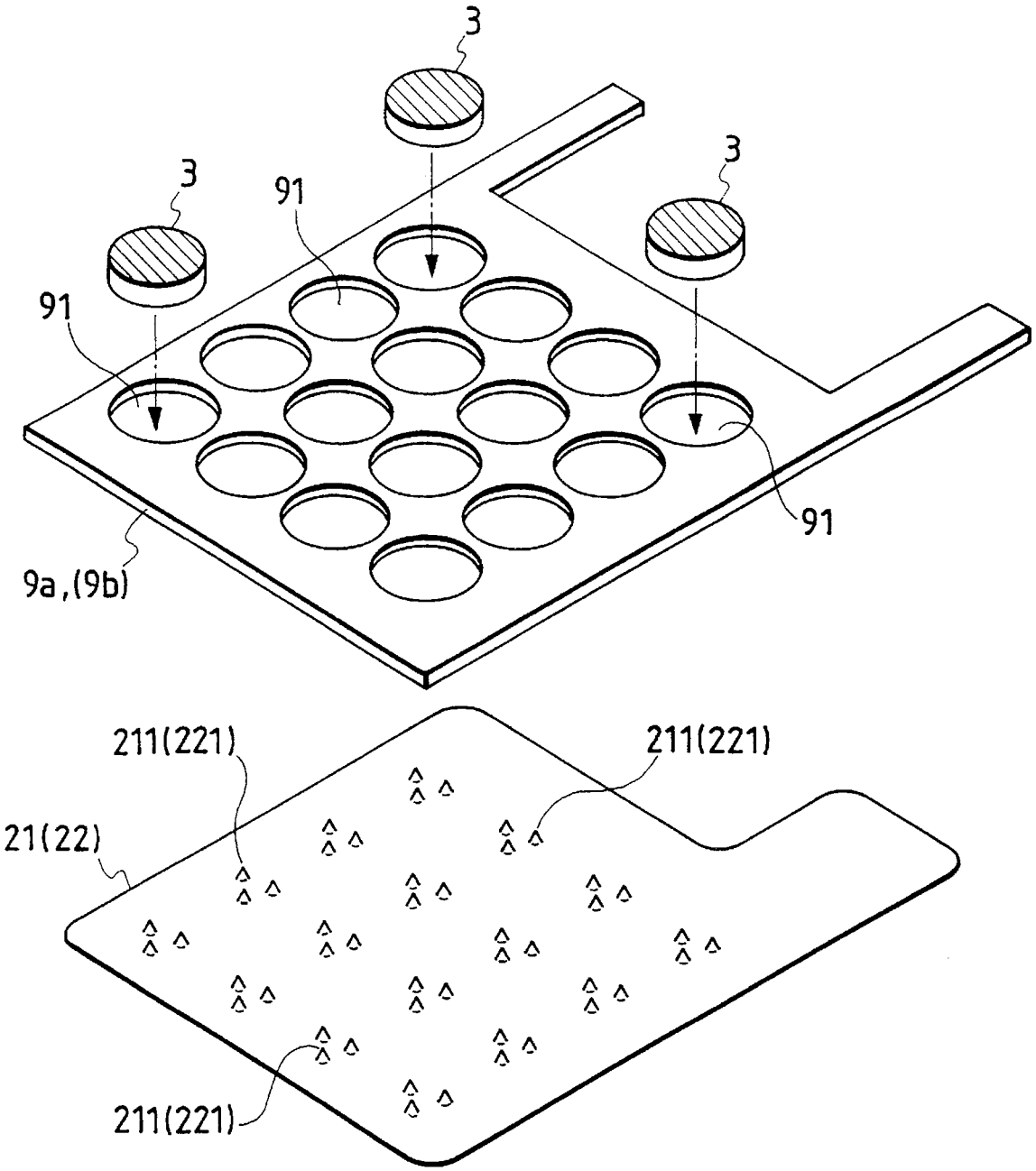
FIG. 11 is a an enlarged perspective view showing a combination of an insulating frame member and electrode plates which constitute the heater of FIG. 10.
Figure 12:
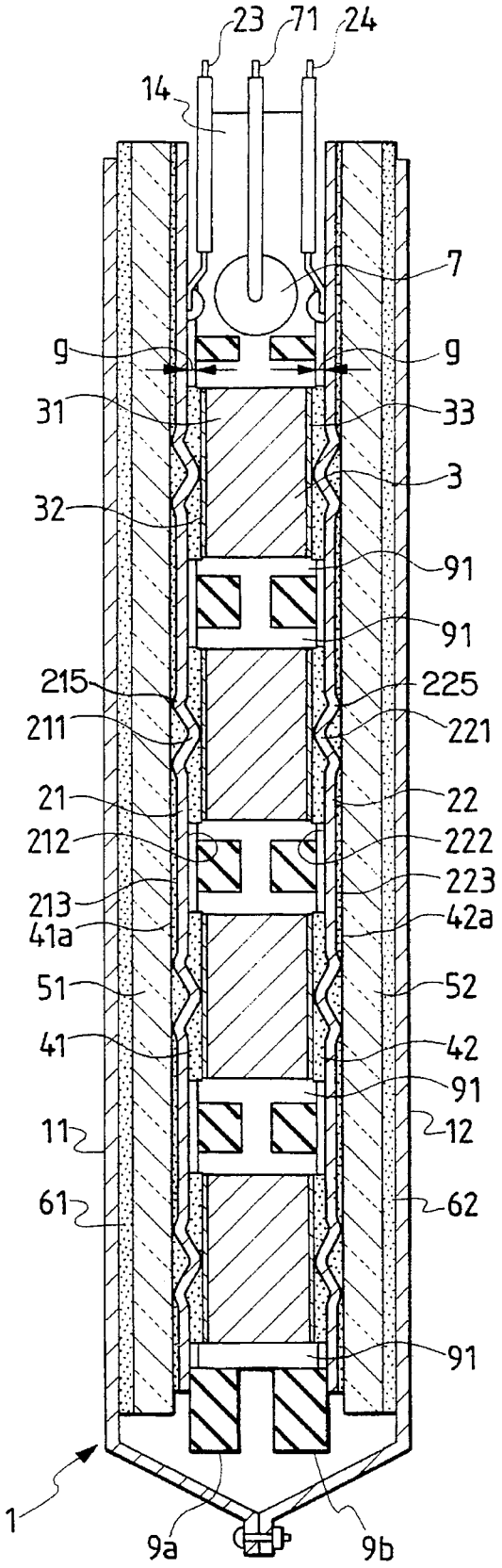
FIG. 12 is a section view showing an assembled state of the heater of FIGS. 10 and 11.

FIG. 10 is an exploded perspective view showing a further embodiment of the heater of the invention, FIG. 11 is an enlarged perspective view showing a combination of insulating frame members and electrode plates which constitute the heater of FIG. 10, and FIG. 12 is a section view showing an assembled state of the heater of FIG. 10. In the figures, the reference numerals same as those of FIGS. 1 to 4 designate the identical components.

The heater of the embodiment comprises two insulating frame members 9*a* and 9*b*. Each of the insulating frame members 9a and 9b has the holes 91 for receiving the PTC thermistors 3 at a position. The insulating frame members 9a and 9b are fixed to the electrode plates 21 and 22 by an adhesive or the like. The PTC thermistors 3 are disposed in the holes 91 of the insulating frame members 9a and 9b, respectively. The thicknesses of the insulating frame members 9a and 9b are set so that a sum of the thicknesses is smaller than the thickness of each PTC thermistor 3. When the electrode plates 21 and 22 to which the insulating frame members 9a and 9b are opposed to each other so as to hold the PTC thermistors 3, therefore, the insulating frame members 9a and 9b are fixed are prevented from being contacted with each other, thereby allowing air to be supplied through a gap formed between the insulating frame members. In the same manner as the embodiment described above, consequently, a reduction reaction of the PTC thermistor 3 due to air is prevented from occurring, and deterioration of the PTC thermistors 3, and a thermal runaway and destruction associated therewith are surely prevented from occurring.

Figure 8:
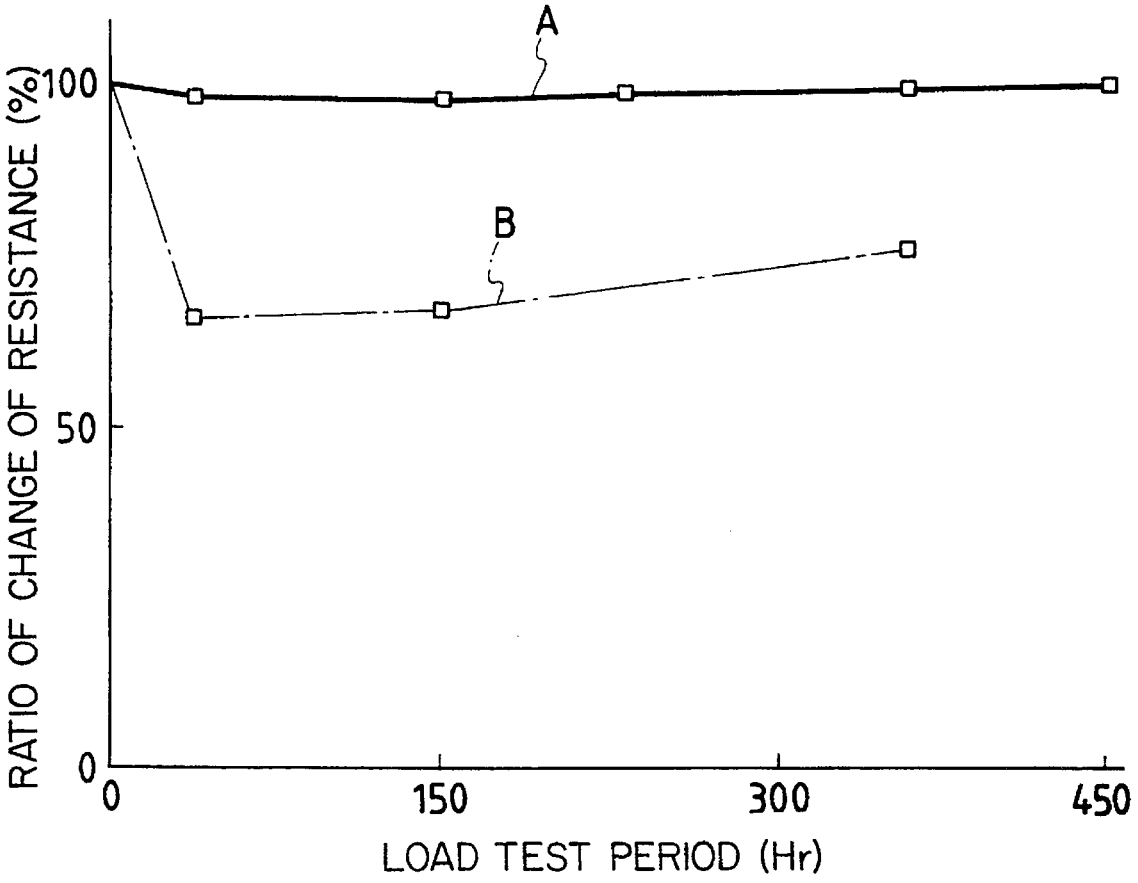
FIG. 8 is a graph showing data of measurements conducted on the relationship between a load test period and a rate of change of resistance of PTC thermistors.

FIG. 8 is a graph showing data of measurements conducted on the relationship between a load test period and a rate of change of resistance of PTC thermistors. The data of FIG. 8 were obtained as follows: A rate of change (%) of a resistance at a time when an AC voltage of 200 V was applied to a PTC thermistor for a predetermined period with respect to the initial resistance (ordinary temperature) of the PTC thermistor was obtained, and plotted as a rate of change of resistance (%) with respect to the load test period (Hr) in FIG. 8. The curve A shows characteristics obtained under measurement conditions equivalent to the embodiment shown in FIGS. 5 to 7, and the curve B shows characteristics obtained under measurement conditions equivalent to a configuration in which the air paths 92 were not formed in the embodiment shown in FIGS. 5 to 7. As seen from comparison of the curves A and B, a rate of change of resistance of 100% is obtained in the case where no air path is formed, and the rate of change of resistance is suppressed to about 50% in the case of the invention in which the air paths are formed. Consequently, a thermal runaway and destruction of PTC thermistors due to a change of resistance are surely prevented from occurring.

Referring again to FIGS. 5 and 6, the insulating frame member 9 has two step portions 93 and 94 at its periphery. The step portion 93 supports the peripheries of the electrode plates 21 and 22, and the step portion 94 supports those of the electrical insulating members 51 and 52. This allows an assembled structure in which the electrode plates 21 and 22, the electrical insulating members 51 and 52, and the insulating frame member 9 are integrated with the PTC thermistors 3, to be realized, thereby facilitating the process of assembling the heater.

In a heater device of an example of the invention, PTC thermistors having a diameter of 17 mm and a thickness of 2.5 mm are used, and stainless steel plates of a thickness of 0.1 mm on which projections of a height of about 0.8 to 1.0 mm are formed are used as the electrode plates 21 and 22. Under the state in which the electrode plates are mounted in the heater, since the electrode plates 21 and 22 are pressingly contacted with the PTC thermistors, the height of the projections is reduced to 0.3 to 0.4 mm by the spring function of the electrode plates. Alumina plates of a thickness of 0.6 to 0.7 mm are used as the electrical insulating layers 51 and 52, and a stainless steel plate of a thickness of 0.6 mm is used as the case 1. It is a matter of course that the resin used as the thermal conductive filler preferably has a high thermal conductivity. When the composition of a silicon resin is adequately adjusted, a thermal conductivity as high as $2.0\times10^{-3}$ Cal/cm.sec.° C. can be attained while satisfying the requirements of heat resistance, adhesiveness, and fire resistance.

Figure 9:
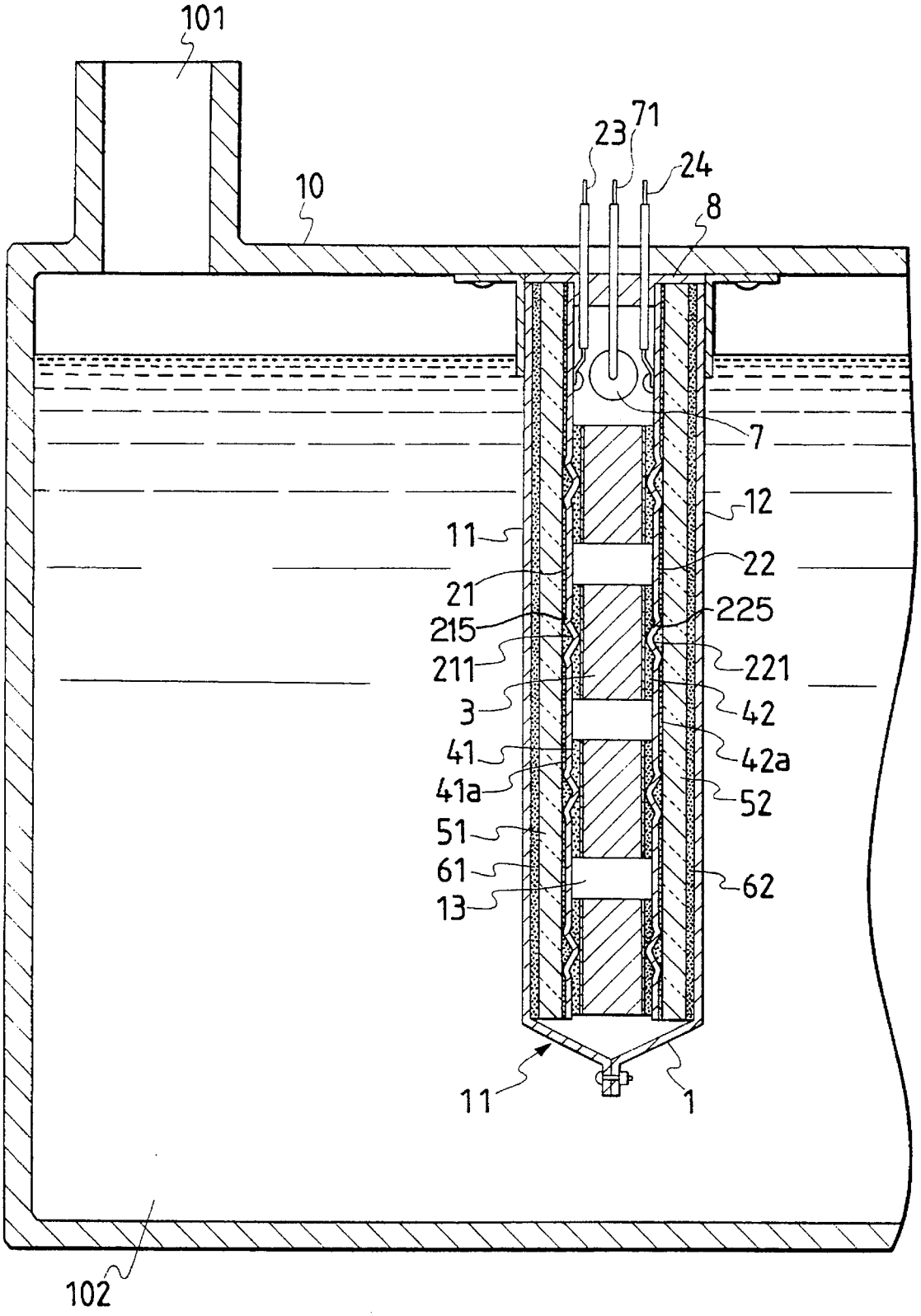
FIG. 9 is a section view showing a part of a humidifier which uses a heater according to the invention.

FIG. 9 is a section view showing a part of a humidifier which uses a heater according to the invention. As illustrated, the humidifier comprises a water storage tank 10, and a heater 11. The water storage tank 10 has a vapor outlet 101. The heater 11 consists of the above-described heater according to the invention, and is mounted in the water storage tank 10 so as to heat water 102 in the water storage tank 10. In the heater 11, the whole of the periphery of the case 1 is closed except the opening 14. Even when the side portion of the case 1 which is opposite to the side portion in the side of the opening 14 is immersed into the water, therefore, the water 102 is prevented from entering the internal space 13 of the case 1 in which the PTC thermistors 3, and the electrode plates 21 and 22 are disposed. Accordingly, the resulting humidifier has a high reliability. The humidifier shown in FIG. 9 uses the heater 10 having the structure of FIGS. 1 to 4. Alternatively, the humidifier may use a heater having the structure of FIGS. 5 to 7.

As described above, the invention can attain the following effects: (a) a heater for heating a liquid which generates heat at a constant temperature on the basis of the self temperature control function is provided; (b) a heater for heating a liquid which can easily be assembled is provided; (c) a heater for heating a liquid in which the electrical contact between a PTC thermistor and electrode plates is surely realized, and the thermal coupling and the thermal efficiency are excellent is provided; (d) a heater in which the thermal coupling and electrical contact between a PTC thermistor and electrode plates are stably realized is provided; (e) according to a preferred example wherein at least one insulating frame member is disposed and has one or more holes the number of which corresponds to the number of PTC thermistors, and the PTC thermistors are respectively disposed in the holes of the insulating frame member, a heater in which an electrical short-circuit between the PTC thermistors due to a positional displacement or movement of the PTC thermistors is prevented from occurring and which has a high reliability is provided; and (f) according to a preferred example wherein an insulating frame member has air paths through which holes are communicated with adjacent ones and led to the outside of the case, deterioration, thermal runaway and thermal destruction of PTC thermistors are surely prevented from occurring.

What is claimed is:

1. A PTC heater for use in liquid comprising:

a case including first and second radiating members having peripheries which engage each other and which are shielded to define an internal space inside said case, said case having an opening between said first and second radiating members;

plural electrode plates arranged in said internal space, each of said electrode plates having elastic projections on both of opposing sides of each of said electrode plates;

at least one positive temperature coefficient thermistor having electrodes provided on opposing surfaces, said at least one positive temperature coefficient thermistor being arranged between said electrode plates while the projections on one of said opposing sides of said electrode plates are in contact with said electrodes;

projections on another of said opposing sides of said electrode plates being engaged with an inside wall of said case; and a thermally conductive adhesive resin disposed between said electrodes of said at least one positive temperature coefficient thermistor and said electrode plates.

2. A PTC heater according to claim 1, further comprising at least one insulating frame member provided between said electrode plates, said insulating frame member having at least one hole in which said at least one positive temperature coefficient thermistor is arranged.

3. A PTC heater according to claim 2, wherein said opening communicates said internal space with outside of said case, said insulating frame member has at least one air path communicating each at least one said hole with the outside of said case via said opening.

4. A PTC heater according to claim 1, further comprising an additional thermally conductive adhesive resin disposed between said electrode plates and said inside wall of said case.

5. A PTC heater according to claim 1, further comprising a pair of insulating frame members provided between said electrode plates and fixed to said electrode plates respectively, each said insulating frame members having at least one hole for positioning said at least one positive temperature coefficient thermistor, a sum of thickness of said insulating frame members being smaller than a thickness of said at least one positive temperature coefficient thermistor.

6. A PTC heater according to claim 1, wherein said case is made of metal, further comprising electrical insulating layers interposed between said case and said electrode plates.

7. A PTC heater according to claim 1, further comprising a thermal fuse for interrupting a power supply to said at least one positive temperature coefficient thermistor when said at least one positive temperature coefficient thermistor abnormally generates heat.

* * * * *